United States Patent [19]

Yamamoto

[11] Patent Number: 4,676,061

[45] Date of Patent: Jun. 30, 1987

[54] EMPTY BOBBIN TRANSPORTING SYSTEM

[75] Inventor: Yoshio Yamamoto, Kyoto, Japan

[73] Assignee: Murata Kikai Kabushiki Kaisha, Kyoto, Japan

[21] Appl. No.: 620,138

[22] Filed: Jun. 13, 1984

[30] Foreign Application Priority Data

Jun. 14, 1983 [JP] Japan ..... 58-107429

[51] Int. Cl.[4] ..... D01H 9/18; D01H 9/00; B65H 67/06

[52] U.S. Cl. ..... 57/276; 57/90; 57/266; 57/274; 57/281; 209/927; 242/35.5 R; 242/35.5 A

[58] Field of Search ..... 57/266, 268, 276, 274, 57/281, 90; 209/927; 242/35.5 R, 35.5 A

[56] References Cited

U.S. PATENT DOCUMENTS

| | | | |
|---|---|---|---|
| 3,195,298 | 7/1965 | Furst | 242/35.5 R X |
| 3,410,406 | 11/1968 | Tsuda et al. | 57/281 X |
| 3,608,293 | 9/1971 | Brouwer | 57/281 |
| 3,768,241 | 10/1973 | Nelson et al. | 57/281 |
| 4,041,686 | 8/1977 | Imaba et al. | 57/266 X |
| 4,181,228 | 1/1980 | Hashimoto et al. | 242/35.5 A X |
| 4,432,198 | 2/1984 | D'Agnolo | 242/35.5 R X |

*Primary Examiner*—John Petrakes

*Attorney, Agent, or Firm*—Spensley Horn Jubas & Lubitz

[57] ABSTRACT

An empty bobbin transporting system for a fine spinning winder wherein a spinning frame and a winder are interconnected by way of a spinning bobbin transporting path and an empty bobbin transporting path. An additional transporting path for transporting an empty bobbin fed back from the winder and an empty bobbin stock device for temporarily stocking the empty bobbin transported by the additional transporting path are provided in the spinning frame.

8 Claims, 7 Drawing Figures

EMPTY BOBBIN TRANSPORTING SYSTEM

BACKGROUND OF THE INVENTION

1. Field of the Invention

This invention relates to a bobbin transporting system for a spinning frame and a winder including a plurality of winding units.

2. Prior Art

Various proposals have been made so far for what is called a fine spinning winder wherein a spinning frame and a winder is interconnected to each other. In particular, in a fine spinning winder adapted for production of various kinds of goods in a small quantity, spinning bobbins doffed by a spinning frame are supplied, without being packed in a box, one after another to a winder by a transporting means such as a conveyor or the like within a plant. After having been rewound by the winder, the empty bobbins are fed back to the spinning frame by another transporting means such as a conveyor or the like or by any other suitable feeding means so that they may be supplied properly to fine spinning spindles of the spinning frame.

In this instance, where such a spinning frame and a winder constitute a closed loop together with a spinning bobbin transporting path and an empty bobbin transporting path, they must be in a well balanced condition in processing capacity. In particular, before layers of yarns on spinning bobbins which have been doffed by the spinning frame all at once and supplied to the winder are used up, spinning bobbins of a subsequent next lot must necessarily have been produced already by the spinning frame. Or, at least unless the production capacity of the spinning frame is superior to the processing capacity of the winder, the winder may sometimes have an idle time.

Accordingly, it is necessary for the spinning frame to receive a supply of empty bobbins directly after doffing, that is, directly after yarns have been wound up into spinning bobbins.

Meanwhile, in a spinning frame, and especially in a ring spinning frame, a number of fine spinning spindles are arranged in back-to-back relationship in two rows. And in a system wherein spinning bobbins are doffed all at once by one after the other of such two rows of fine spinning spindles, it is necessary that empty bobbins be already prepared in position for all of the fine spinning spindles before such doffing of spinning bobbins.

SUMMARY OF THE INVENTION

An object of the present invention is to provide a system which can assuredly supply empty bobbins to individual fine spinning spindles.

In particular, the invention provides an empty bobbin transporting system which includes a transporting path for transporting an empty bobbin fed back from a winder to an empty bobbin supplying position of a spinning frame; and a stock device for temporarily stocking the empty bobbin thus transported by the transporting path, the stock device being capable of receiving a supply of empty bobbins from outside a closed loop of the fine spinning winder.

DETAILED DESCRIPTION OF THE INVENTION

An embodiment of the present invention will be described below with reference to the accompanying drawings.

Figure 2:
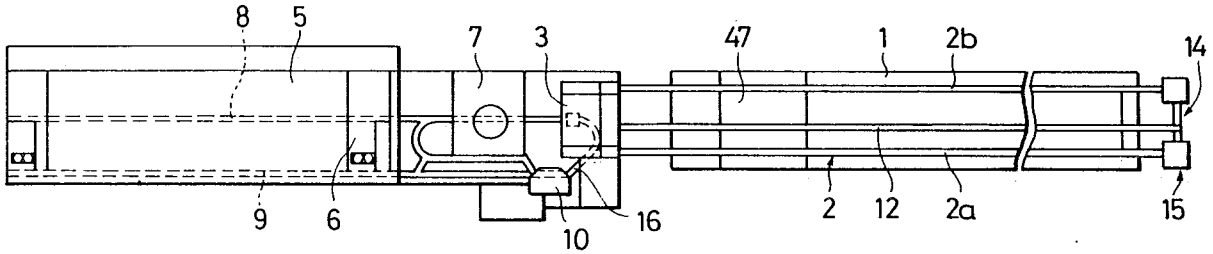
FIG. 2 is a plan view of the spinning frame of FIG. 1.
Figure 1:
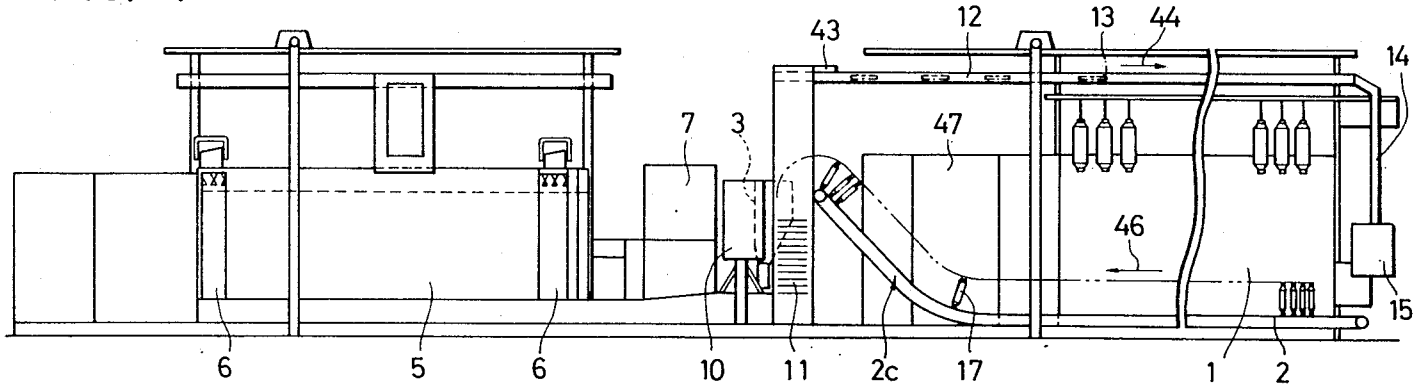
FIG. 1 is a front elevational view showing a general construction of a fine spinning winder to which a system of the present invention is applied.

Referring to FIGS. 1 and 2 which are diagrammatic representations of an example of fine spinning winder, a spinning bobbin on which a spinning yarn produced by a spinning frame 1 is wound is fitted and supported, for example, on a peg on a transport band 2, and is fed in a longitudinal direction along the spinning frame 1. Then, the spinning bobbin is thrown into a spinning bobbin supplying device 3 and is erectly fitted onto a spinning bobbin transporting means in a stand-by position below, such as, for example, a carrier (designated by 4 in FIG. 4) which is fed on a belt conveyor, so that it is supplied to one of winding units 6 of a winder 5. Reference numeral 7 denotes a preparation apparatus which has a pick finding device for picking up a tail end of a yarn on a spinning bobbin doffed from the spinning frame, a sensor for detecting presence or absence of a layer of a yarn on a spinning bobbin, and so on.

Supply of spinning bobbins to winding positions of individual winding units of the winder 5 is effected from a spinning bobbin transporting conveyor 8 while they are held fitted on the carriers. Empty bobbins after completion of unwinding of yarns therefrom and bobbins having yarn segments left thereon are fed by means of an empty bobbin transporting conveyor 9 arranged to extend along the winding units to a bobbin processing device 10 at which the empty bobbins are separated from the bobbins with the remaining yarns thereon. The empty bobbins pulled off the respective carriers by the processing device 10 are then fed upwardly by means of an empty bobbin lifting device 11 and then horizontally by means of a belt conveyor 12 which extends in a longitudinal direction above the spinning frame. The empty bobbins 13 thus fed to an end of the spinning frame are dropped into a stock device 15 by way of a chute 14 and are stored therein until they are supplied and fitted individually on empty carriers on the transport band 2 below at respective suitable points of time. In the meantime, carriers from which empty bobbins and small amount of yarn bobbins have been removed into empty conditions at the bobbin processing device 10 are further fed on a conveyor 16 to the aforementioned spinning bobbin supplying device 3 in order to receive a supply of new spinning bobbins 17 there.

In this way, the spinning frame 1 and winder 5 are interconnected directly to each other by means of the spinning bobbin transporting path 8 and the empty bobbin transporting path 12, thereby constituting a closed loop.

Figure 3:
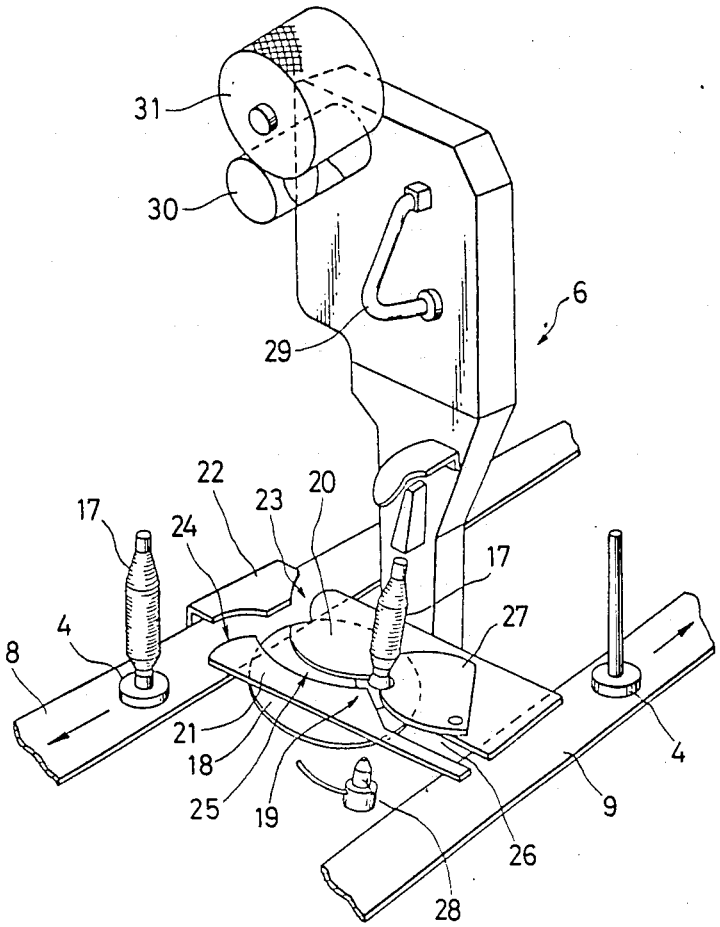
FIG. 3 is a perspective view showing a general construction of an automatic winder which can be applied to the system of the invention.

FIG. 3 illustrates an example of winder which can be applied to such a system as described above. In particular, a plurality of winding units 6 are arranged in a juxtaposed relationship to constitute a winder 5 and are located between a spinning bobbin transporting path 8 and an empty bobbin transporting path 9. Reference numeral 18 designate a rotatable disk for feeding a spinning bobbin on the transporting path 8 to a rewinding position 19 and for discharging an emptied bobbin from which a yarn has been unwound onto the other transporting path 9. A pair of guide plates 20 and 21 are located in a spaced relationship above the rotatable disk 9 and cooperate with a further guide plate 22 to define a spinning bobbin inlet port 23 and a surplus spinning bobbin outlet port 24 therebetween while they define therebetween a spinning bobbin stand-by guideway 25 and a bobbin ejecting guideway 26. A connecting point between the spinning bobbin stand-by guideway 25 and the bobbin ejecting guideway 26 defines the rewinding position 19 described above. Reference numeral 27 denotes a lever for ejecting an empty bobbin or a bobbin with a remaining yarn thereon.

Located below the carrier at the rewinding position 19 is a compressed air injecting nozzle 28 which is connected to a compressed air supply source by way of a conduit. Compressed air injected from the nozzle 28 is introduced into a spacing within a peg of the carrier 4 from an arcuate slit not shown formed in the rotatable disk 18 and is then injected into a take-up tube of the spinning bobbin to blow an end of a yarn which has been suspended in the take-up tube from an upper end of the take-up tube upwardly outside the core tube. The yarn end thus blown up is sucked into and held by a relay pipe 29 which stands by at a position above the spinning bobbin 17 at the rewinding position 19. The relay pipe 29 then pivots upwardly to introduce the yarn end into a knotter by means of which the end of the yarn on the spinning bobbin is spliced to an end of another yarn on a package. After then, another rewinding operation is started. Reference numeral 30 designates a traverse drum, and 31 a winding package.

Figure 4:
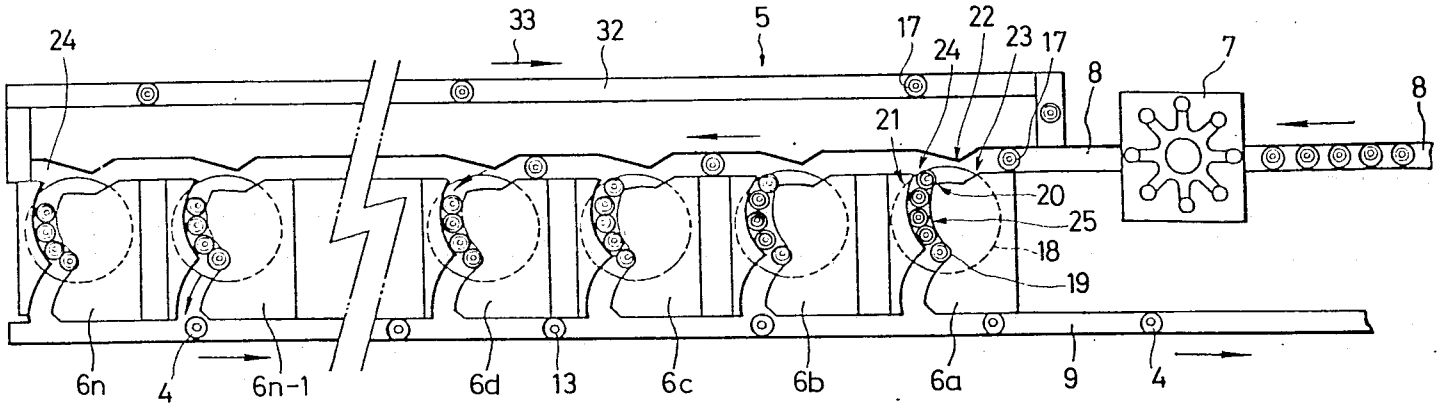
FIG. 4 is a plan view showing a transporting path for spinning bobbins and empty bobbins in the winder of FIG. 3.

FIG. 4 is a plan view showing a spinning bobbin supplying system for supplying spinning bobbins to a winder wherein a number of such winding units 6 as described above are provided in a juxtaposed relationship.

In particular, a spinning bobbin which is fed on the spinning bobbin transporting path 8 comes to the pick finding device 7 at which an end of a yarn which is to be spliced to an end of another yarn is picked up and is introduced into a take-up tube of the spinning bobbin. In this condition, the spinning bobbin is transferred onto the spinning bobbin transporting path 8 of the winder while it is held fitted on a carrier. The spinning bobbin 17 then travels along the spinning bobbin transporting path 8 until the carrier 4 therefor is engaged with the guide plates 20, 21, 22 of a winding unit 6*a*. As a result, the spinning bobbin 17 is guided by the guide plates 20, 21, 22 and is thus transferred onto the rotatable disk 18 so that it is introduced into the stand-by guideway 25 from the spinning bobbin inlet port 23 and thus comes to the rewinding position 19. If succeeding spinning bobbins are admitted one by one into the spinning bobbin stand-by guideway 25 in this way until the spinning bobbin stand-by guideway 25 is filled with a predetermined number of spinning bobbins, further succeeding spinning bobbins are not admitted into the stand-by guideway so that they will go toward a subsequent next winding unit 6*b* by way of the surplus spinning bobbin outlet port 24.

In this manner, the winding units 6*a*, 6*b*, . . . 6*n* are filled one after another with carriers having spinning bobbins fitted thereon, beginning with the one 6*a* which is located nearmost to the pick finding device 7 and ending with the farthermost one 6*n*, and yet if there appear rooms for spinning bobbins in the spinning bobbin stand-by guideways 25 of some of the winding units, then such rooms will be filled one after another with spinning bobbins, beginning with that of one of such winding units which is nearest to the winding unit 6*a*. Further, spinning bobbins which are not admitted by any of the winding units 6*a* to 6*n* and thus go out from the surplus spinning bobbin outlet port 24 of the last winding unit 6*n* at the last position is introduced into a circulating path 32 along which it is fed in a direction of an arrow mark 33 until it is supplied into the spinning bobbin transporting path 8.

Figure 5:
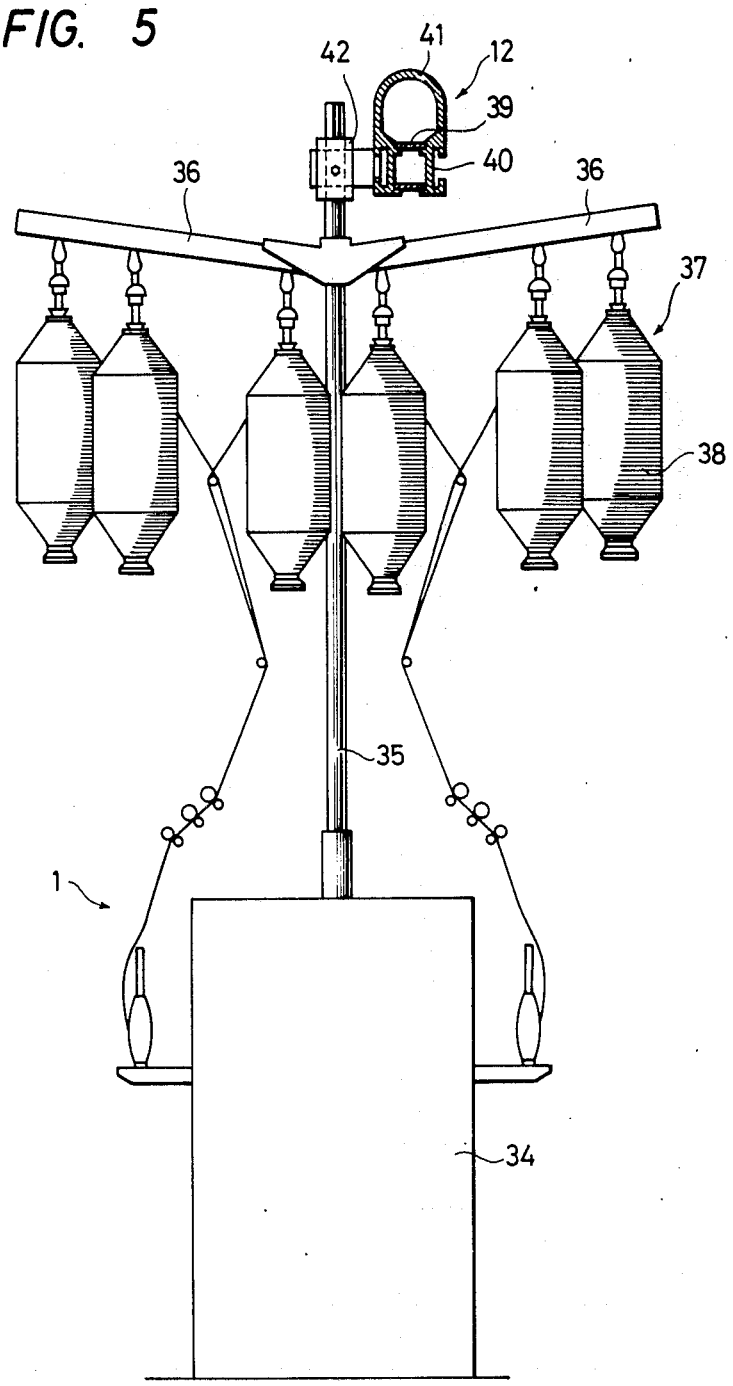
FIG. 5 is a cross sectional side elevational view showing an example of empty bobbin transporting path provided above a spinning frame.

Reference is now had to FIG. 5 which is a sectional view showing an embodiment of the empty bobbin transporting path 12 of FIG. 1. For example, the ring spinning frame 1 includes a spinning frame body 34, and sliver supply devices 37 which depend from and are supported on cross beams 36 which are in turn supported on support posts 35 erected on the spinning frame body 34. The empty bobbin transporting device 12 extends in a longitudinal direction along the spinning frame and is located at an upper position of the support posts 35, that is, above the support beams 36 for sliver bobbins 38. The empty bobbin transporting device 12 is constituted from a conveyor belt 39, a support member 40 for supporting the conveyor belt 39 thereon, a cover 41 for covering over the conveyor, mounting members 42 for mounting the support member 40 on the support posts 35, and so on.

Accordingly, an empty bobbin 13 which has been fed upwardly by the empty bobbin lifting device 11 of FIG. 1 is then delivered onto the conveyor 39 by way of the chute 43 and transferred onto the conveyor which circulates in a direction of an arrow mark 44. As a result, the empty bobbin 13 is transported on the conveyor to the end of the spinning frame at which is is dropped through the chute 14 and stored in the stock device 15. The empty bobbins thus stored are intermittently supplied and fitted onto empty carriers on the transport band 2 at a stand-by position below.

It is to be noted that operations for exchanging empty bobbins on the transport band for spinning bobbins having yarns wound thereon by the spinning frame, that is, doffing operations, are suitably carried out either by means of a known automatic doffing apparatus or by an operator.

Now, an empty bobbin stock device provided adjacent an end of a spinning frame will be described with reference to FIGS. 1, 2, 6 and 7. Referring first to FIGS. 1 and 2, in a particular type wherein the transport band 2 which travels along the spinning frame 1 receives doffed spinning bobbins on pegs (designated by 45 in FIG. 6) on an upper face thereof and travels in a direction of an arrow mark 46 to a left-hand side end position of the spinning frame 1 at which the spinning bobbins 17 are pulled off the pegs of the transport band 2 and are thrown one after another into the spinning bobbin supplying device 3, an empty bobbin stock device 15*a* is located adjacent the opposite right-hand side of the spinning frame 1. In particular, according to such an arrangement, only if the transport band 2 having an endless configuration is circulated in one direction, spinning bobbins 17 can be discharged adjacent an end of the spinning frame while at the same time empty bobbins can be supported onto pegs of the transport band, thus allowing simultaneous discharging of spinning bobbins from the spinning frame and supplying of empty bobbins.

Further, a drive box 47 for the spinning frame is located adjacent the spinning bobbin discharging side of the spinning frame. The transport band 2 can pass through a recess in a lower portion of the drive box.

Figure 6:
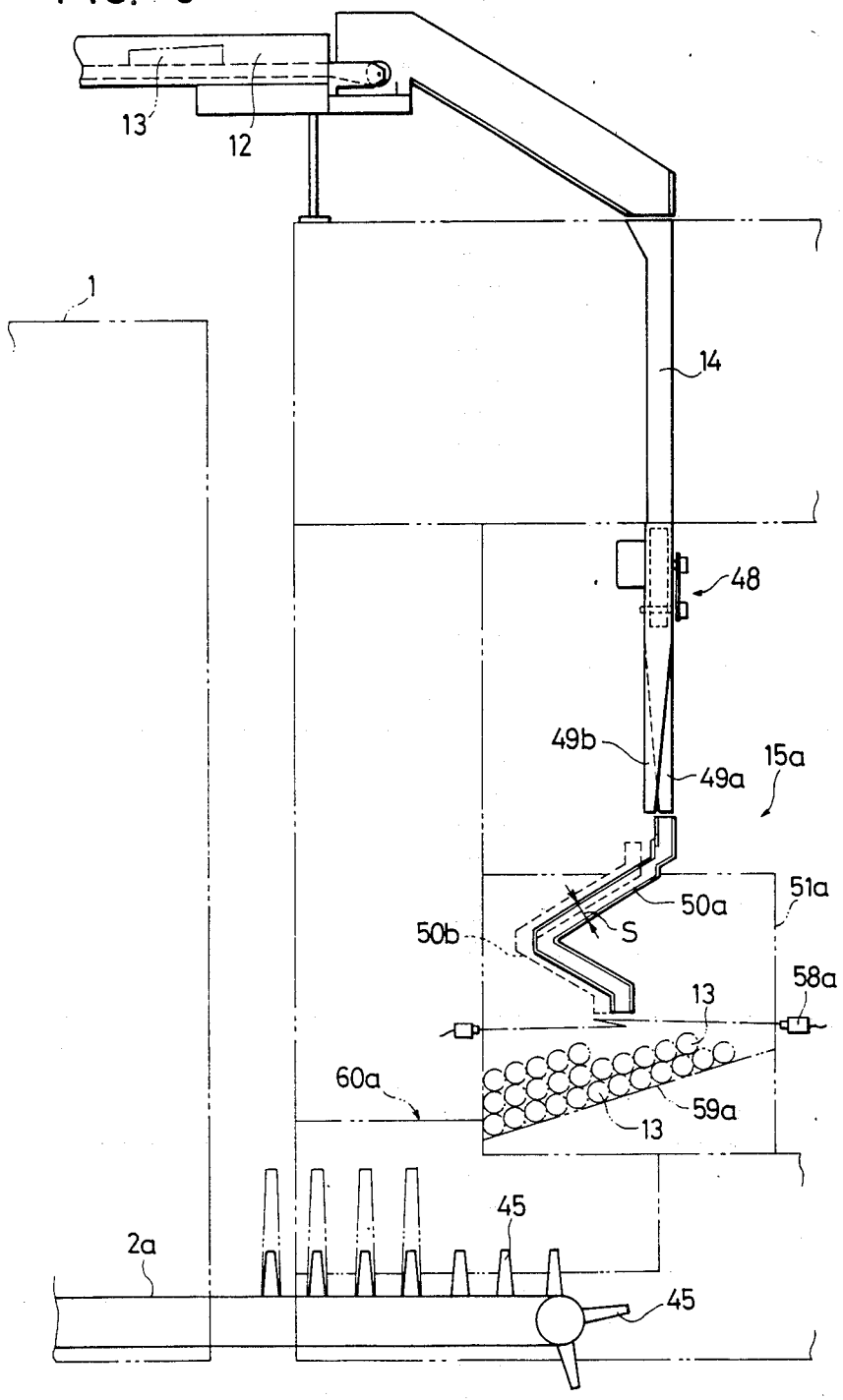
FIG. 6 is a front elevational view showing an embodiment of an empty bobbin stock device.
Figure 7:
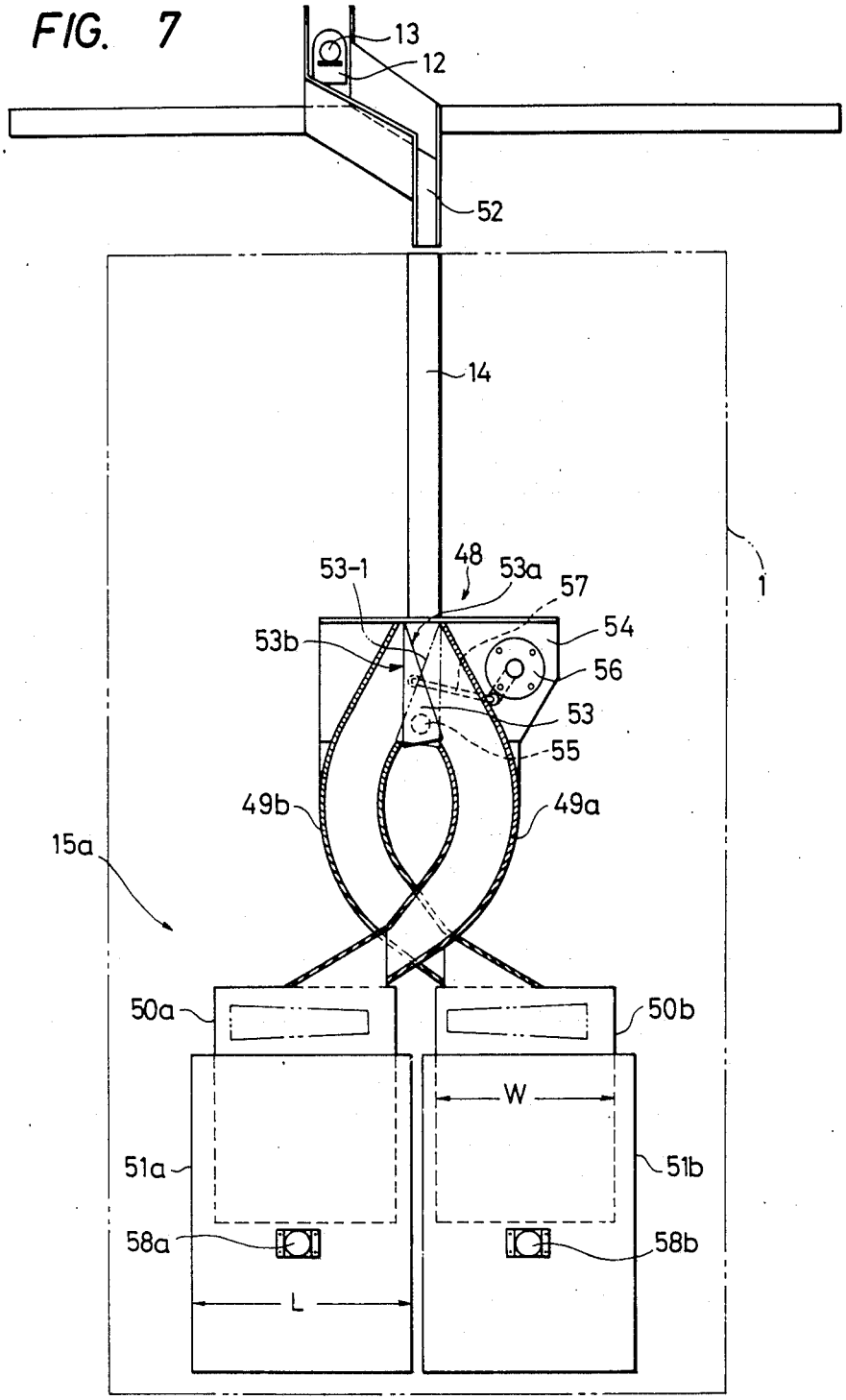
FIG. 7 is a side elevational view of the empty bobbin stock device of FIG. 6.

Referring now to FIGS. 6 and 7, the empty bobbin stock device 15*a* includes the chute 14 provided in corresponding relationship to one of the two rows of the spindles of the spinning frame 1 for receiving empty bobbins dropped from the empty bobbin transporting path 12, a delivery device 48 for delivering such empty bobbins individually to the stock device, chutes 49*a* and 50*a* located below and contiguous to the delivery device 48, and a stock box 51*a*.

While FIG. 6 shows a stock device for one side of the spinning frame, a similar device is provided also for the other side. Located contiguously to an end of the empty bobbin transporting path 12 provided above the spinning frame 1 is an inclined empty bobbin chute 52 having a hollow rectangular or a channel-shaped cross section. The empty bobbin chute 52 is connected to the curved chute 49*a* as shown in FIG. 7, and the bent chute 50*a* is formed within the stock box 51*a*. The chutes 52, 14 and 49*a* have a dimension at least greater than the maximum diameter of an empty bobbin in a horizontal widthwise direction and also in a horizontal depthwise direction so that an empty bobbin dropping through the chutes cannot change its orientation. In particular, in the embodiment shown and described, while an empty bobbin 13 is fed on the empty bobbin transporting path 12, a large diameter portion thereof is directed in the advancing direction as shown in FIG. 6, and hence the empty bobbin 13 drops through the chutes 52, 14, 49*a* with the large diameter portion thereof directed downwardly. It is to be noted that the chute 50*a* contiguous to the chute 49*a* is a zigzag chute having a width W substantially equal to the length and a gap S substantially equal to the maximum diameter of an empty bobbin so that it may absorb a shock and it can store empty bobbins 51*a* with the same horizontal orientations within the box 5*a*.

The empty bobbin delivery device 48 includes, as shown in FIG. 7, a movable guide plate 53 having guide faces 53*a* and 53*b* thereon and pivotally supported at 55 on a bracket 54. The guide plate 53 is positioned at a branch point of the chutes 49*a*, 49*b* and is connected, by means of a connecting bar 57, to an actuator 56 such as a rotary solenoid, a hydraulic cylinder or the like connected to the bracket so that it may be moved between two positions by the actuator 56 which operates in response to a changing over signal.

Further, a pair of sensors 58*a* for detecting an amount of empty bobbins stored in the stock box 51*a* in which the chute 49*a* is contained are disposed at fixed positions of the stock box 51*a*. Each of the sensors may be a photo-electric tube sensor or a mechanically operable feeler, and other sensors such as a sensor for detecting and counting passage of an empty bobbin may be provided at an intermediate position of the chute 14. Further, the stock box 51*a* may be a box which is open at the top thereof or which has an openable and closable lid and which has a width L substantially equal to the length of an empty bobbin. The stock box 51*a* has an inclined plate 59*a* mounted on an inner bottom wall thereof, and the inclined plate 59*a* is connected at a lower end thereof to an empty bobbin releasing device 60*a*.

Description will be given below of a method of transporting spinning bobbins and empty bobbins in the system having such devices as described above.

When spinning bobbins on spindles in one of the two rows of the fine spinning frame 1 are filled with yarns and are thus to be doffed, empty bobbins on a transport band 2*a* which are positioned in a spaced relationship by a distance equal to a spindle pitch along the row of the spindles are pulled beforehand off pegs of the transport band 2*a* all at once and are exchanged for the fully wound spinning bobbins on the spindles. Thus, the spinning bobbins 17 are placed in good order on the transport band 2*a*. Thereafter, in response to a spinning bobbin demanding signal of the spinning bobbin supply device (3 of FIG. 2), the transport band 2*a* begins an intermittent circulation so that the spinning bobbins are intermittently fed by one pitch of the pegs in a direction of the arrow mark 46. Then, the spinning bobbins are thrown into the spinning bobbin supplying device 3 from the top end of an inclined portion 2*c* of the band 2*a* and are thus fitted on the empty carriers (4 of FIG. 3) at a stand-by position below.

Meanwhile, adjacent the right-hand side end of a horizontal portion of the transport band 2*a*, empty bobbins are released one by one from the empty bobbin stock box 15 and are thus supplied and fitted on pegs 45 on the band 2*a*.

Now, when empty bobbins are supplied from the empty bobbin stock box 51*a* of FIG. 7, the rotary solenoid 56 operates in response to a signal for starting circulation of the transport band to position the movable guide plate 53 to a position as shown in full lines in FIG. 7. As a result, empty bobbins 13 which are fed from the empty bobbin transporting path 12 and dropped through the chute 14 are guided toward the chute 49*a* by the guide face 53*a* of the movable guide plate 53 so that they are thrown into the stock box 51*a* in orderly orientations. It is to be noted that the stock box 51*a* has a plurality of empty bobbins stored in prior therein so that empty bobbins may be supplied onto empty pegs on the transport band directly after starting of circulation of the transport band. Accordingly, an empty bobbin can be fitted on a peg directly following that peg on the transport band 2*a* of FIG. 1 which has the rearmost one of the spinning bobbins fitted thereon, and hence there will be no empty peg present between the spinning bobbins and the empty bobbins on the transport band. Accordingly, from the top end of the inclined portion 2*c* of the transport band 2*a*, spinning bobbins are assuredly supplied one by one after each circulation by one pitch of the transport band 2*a* so that one spinning bobbin is supplied assuredly onto an empty carrier at a stand-by position below by one operation.

Also while spinning bobbins are fed successively in this manner, empty bobbins are continuously supplied into the stock box 51*a* of FIG. 7, and when the forwardmost one of empty bobbins on the transport band comes to a position directly before a leftmost one of the fine spinning spindles, circulation of the band 2*a* is stopped while supply of empty bobbins into the stock box 51*a* is continued until the sensor 58*a* detects a stock of empty bobbins in a predetermined quantity. Upon detection of the stock of empty bobbins in the predetermined quantity by the sensor, a changing over signal is delivered to the rotary solenoid 56 so that the movable guide plate 53 is moved to a two dots and dash line position 53-1. As a result, empty bobbins which drop through the chute 14 after then are guided into the chute **49*b* and are thus supplied to an empty bobbin stock box 51*b*** which is provided corresponding to the other row on the other side of the spinning frame.

In this manner, empty bobbins are circulated between the spinning frame and the winder and is fed along the closed loop, but according to the bobbin processing device indicated by reference numeral 10 in FIG. 1, empty bobbins which are sorted from small amount of yarn bobbins are fed back to the spinning frame again as described above while the bobbins with minimum remaining yarns thereon may be stored in a separate pool or a container box and may be removed outside the closed loop system. In other words, the total amount of empty bobbins which circulate along the closed loop may sometimes decrease as time passes. In order to cope with this situation, according to the system of the present invention, the same number of empty bobbins as the empty bobbins which have been discharged outside the system from the bobbin processing device 10 can be supplied into the empty bobbin stock boxes **51*a* and 51*b*** at any time from outside the chutes either by an operator or automatically.

As apparent from the foregoing description, according to the present invention, an empty bobbin transporting system for a fine spinning winder wherein a spinning frame and a winder are interconnected by way of a spinning bobbin transporting path and an empty bobbin transporting path includes an additional transporting path for transporting an empty bobbin fed back from the winder to an empty bobbin supplying position of the spinning frame, and a stock device for temporarily stocking the empty bobbin thus transported by the additional transporting path, the stock device being capable of receiving a supply of empty bobbins from outside the transporting paths of the fine spinning winder. Accordingly, even if there is a difference in processing capacity between the winder and the spinning frame, or whether there is a little or large quantity of empty bobbins fed back from the winder, it can be adjusted at the stock device, thus allowing empty bobbins to be supplied quickly in response to a demand of the spinning frame for an empty bobbin.

In addition, empty bobbins can be supplied also from outside the bobbin transporting paths and hence adjustment can be easily attained to maintain constant the total amount of empty bobbins and spinning bobbins which circulate within the closed loop of the fine spinning winder.

What is claimed is:

1. A bobbin transporting system comprising:

a spinning frame;

a winder;

a first transporting path for transporting empty bobbins from said winder;

an empty bobbin stock device adjacent said first transporting path for receiving empty bobbins from said first transporting path, storing said empty bobbins delivered to said stock device from said first transporting path and for discharging said empty bobbins, said empty bobbin stock device having an opening therein through which empty bobbins may be supplied from a source other than said first transporting path; and a second transporting path for receiving said empty bobbins discharged from said empty bobbin stock device and delivering said empty bobbins to said spinning frame.

2. A bobbin transporting system as claimed in claim 1, wherein said first transporting path comprises:

a belt conveyor; and a support member located adjacent said spinning frame for supporting said belt conveyor.

3. A bobbin transporting system as claimed in claim 1, wherein said empty bobbin stock device comprises:

a first chute for receiving bobbins from said first transporting path;

a delivery device, said first chute enabling said bobbins to be delivered from said first transporting path to said delivery device; and a stock box for receiving bobbins from the delivery device.

4. A bobbin transporting system as claimed in claim 3, wherein said chute contains orientation means for uniformly orienting the empty bobbins passing into said stock box.

5. A bobbin transporting system as claimed in claim 3, further comprising:

a second stock box; and a second chute for transporting bobbins from said first transporting path to said second stock box, wherein said delivery device includes a guide means movable between a first and second position for directing said bobbins into said second chute while in a second position and into said first chute while in a first position.

6. A bobbin transporting system as claimed in claim 3, wherein said empty bobbin stock box includes sensor means for detecting the number of empty bobbins within said empty bobbin stock box.

7. A bobbin transportation system comprising:

a spinning frame;

a winder;

a first bobbin transporting path for transporting empty bobbins from said winder;

bobbin storage means located adjacent said first bobbin transporting path for receiving and storing a plurality of empty bobbins from the first bobbin transporting path;

a second bobbin transporting path for transporting empty bobbins between said bobbin storage means and said spinning frame;

discharge means for discharging empty bobbins from said bobbin storage means to said second bobbin transporting path, wherein the first transporting path, bobbin storgage means, discharge means and second bobbin transporting path form a closed loop for bobbin transportation between the winder and spinning frame; and means for selectively removing bobbins from the closed loop;

wherein said bobbin storage means has an opening therein through which empty bobbins may be supplied from a source other than said first transporting path.

8. A bobbin transportation system, comprising:

a winder;

a first spinning frame;

a second spinning frame;

a first transporting path for transporting bobbins away from said winder;

means for removing bobbins having residual yarn thereon from the first transporting path, thereby reducing the number of bobbins on the first transporting path;

a first stock device adjacent said first transporting path for receiving bobbins from said first transporting path, storing said received bobbins, and discharging said stored bobbins, said first stock device having an opening therein through which empty bobbins may be supplied from a source other than said first transporting path;

a second stock device adjacent said first transporting path for receiving bobbins from said first transporting path, storing said received bobbins, and discharging said stored bobbins, said second stock device having an opening therein through which empty bobbins may be supplied from a source other than said first transporting path;

a second transporting path for transporting bobbins discharged from said first stock device to said first spinning frame;

a third transporting path for transporting bobbins discharged by said second stock device to said second spinning frame;

a fourth transporting path for transporting bobbins from said first and second spinning frames to said winder, said first transporting path, second transporting path and fourth transporting path forming a closed loop path, and said first transporting path, third transporting path and fourth transporting path forming a closed loop path; and guide means for guiding bobbins from said first transporting path alternately into said first stock device and said second stock device.

* * * * *